United States Patent [19]

Nawata et al.

[11] Patent Number: 4,719,959

[45] Date of Patent: Jan. 19, 1988

[54] APPARATUS FOR CONTINUOUSLY PRODUCING HOLLOW METALLIC INGOT

[75] Inventors: Susumu Nawata, Shimizu; Katsuzo Ichikawa, Fujinomiya; Eikichi Sagisaka, Shimizu; Masaharu Sugiyama, Numazu, all of Japan

[73] Assignee: Nippon Light Metal Co., Ltd., Tokyo, Japan

[21] Appl. No.: 45,771

[22] Filed: Apr. 29, 1987

Related U.S. Application Data

[63] Continuation-in-part of Ser. No. 693,163, Jan. 22, 1985, abandoned.

[30] Foreign Application Priority Data

Jun. 12, 1984 [JP] Japan ..... 59-258310

[51] Int. Cl.[4] ..... B22D 11/04

[52] U.S. Cl. ..... 164/421; 164/465

[58] Field of Search ..... 164/465, 421, 420, 464

[56] References Cited

U.S. PATENT DOCUMENTS

| | | | |
|---|---|---|---|
| 2,983,972 | 5/1961 | Moritz | 164/420 |
| 3,331,430 | 7/1967 | Earl, Jr. | 164/465 |
| 3,342,252 | 9/1967 | Wood et al. | 164/421 |
| 3,349,838 | 10/1967 | Baier | 164/437 |
| 3,481,391 | 12/1969 | Nowak | 164/464 |
| 3,702,155 | 11/1972 | Getselev | 164/420 |
| 3,710,840 | 1/1973 | Fabens, Jr. | 164/465 |
| 3,735,803 | 5/1973 | Arrington et al. | 164/465 |
| 3,780,789 | 12/1973 | Unger | 164/420 |
| 3,794,102 | 2/1974 | Binder | 164/465 |
| 3,834,447 | 9/1974 | Luchok et al. | 164/420 |
| 4,000,773 | 1/1977 | Sevastakis | 164/465 |
| 4,078,600 | 3/1978 | Cashdollar, Sr. | 164/420 |
| 4,506,723 | 3/1985 | Bellocci et al. | 164/465 |

*Primary Examiner*—Gene P. Crosby
*Assistant Examiner*—Samuel M. Heinrich
*Attorney, Agent, or Firm*—Oblon, Fisher, Spivak, McClelland & Maier

[57] ABSTRACT

The apparatus comprises an annular water-cooled metallic mold having open upper and lower ends, a core member located in the inner space of the mold to form therebetween an annular casting passage for solidifying therein the molten metal supplied in the casting passage, and a movable supporting base member adapted to initially close the lower end of the casting passage to support the molten metal therein and then to be moved downwardly apart from the lower end as the metal in the casting passage solidifies so as to permit the solidified metal to be pulled out from the casting passage for continuously producing the hollow metallic ingot. The core member comprises a heat-insulating member having a molten metal receiving vessel mounted thereon with at least one molten metal conducting passage formed therein communicating with the casting passage so as to supply the molten metal from the vessel to the casting passage, and a casting member made of graphite or a carbonic material and secured to the lower side of the heat-insulating member with the outer peripheral surface being tapered downwardly inwardly to form a casting face.

8 Claims, 8 Drawing Figures

APPARATUS FOR CONTINUOUSLY PRODUCING HOLLOW METALLIC INGOT

This application is a continuation-in-part of application Ser. No. 06/693,163, filed on Jan. 22, 1985, now abandoned.

FIELD OF THE INVENTION

The present invention relates to an apparatus for continuously casting hollow metallic ingot having a cross-section in the circular, rectangular or relatively simple closed loop form, and, more particularly, to an apparatus suitable to continuously cast thin-walled hollow metallic ingot having the wall-thickness of 10–100 mm wherein the inner peripheral surface of the hollow ingot can be made smooth and sound.

BACKGROUND OF THE INVENTION

Heretofore, in order to continuously cast a hollow metallic ingot such as aluminum alloy usually having a cross-section in the circular form, a water-cooled metallic core member having the cross-section of the outer peripheral surface so shaped as to define the configuration in cross-section of the inner peripheral surface of the hollow metallic ingot to be continuously cast is placed in position in the inner space of an open ended annular water-cooled metallic mold having the cross-section of the inner peripheral surface so shaped as to define the configuration in cross-section of the outer peripheral surface of the hollow ingot so that an open ended annular casting passage is formed between the mold and the core member. A movable cradle or an annular supporting base member is first located so as to close the lower open end of the casting passage, and, thereafter, molten metal is continuously supplied into the upper open end of the casting passage so as to cause solidification of the molten metal at an appropriate position between the upper and lower ends of the casting passage by forcibly cooling the mold and the core member. After the solidification of the molten metal has commenced, the annular supporting base member is gradually lowered apart from the lower end of the casting passage together with the base member so as to be water-cooled from the inside and the outside of the solidified hollow metal to form the hollow ingot, while the molten metal is continuously supplied into the upper end of the casting passage so as to compensate for the amount of the metal pulled out from the casting passage, thereby maintaining the steady state of the continuous casting operation. The supply of the molten metal in the casting passage for the initial charge and thereafter for supplementing the amount of the solidified metal pulled out from the casting passage is usually effected by a plurality of molten metal supplying devices directly located in spaced relationship from each other in the annular casting passage. Each molten metal supply device is provided with a molten metal level controller consisting of a float and dip tubes with the lower ends extending in the flat bottomed recess in the float so that, when the level of the molten metal descends to lower the float, the lower ends of the tubes are spaced from the flat bottom so as to supply the molten metal through the tubes, whereas, when the level is raised so as to cause abutment of the flat bottom against the lower ends of the tubes, the supply of the molten metal through the tubes is stopped so as to maintain the level constant.

With such an apparatus as described above wherein the inner and outer peripheral surfaces of the hollow ingot to be continuously cast are forcibly cooled by the water-cooled mold and the water-cooled core member, the following difficulties can not be avoided. That is, solidified shells are first formed at the outer peripheral surface and the inner peripheral surface of the molten metal supplied into the casting passage and, thereafter, the solidification of the molten metal proceeds toward the interior thereof between the outer and inner peripheral surfaces, thereby resulting in shrinkage of the metal between the outer and inner solidified shells. Therefore, since the shells are rigid and will not be subjected to shrinkage, cracks tend to occur in the interior of the solidified metal. Further, since the amount of shrinkage at the side of the inner peripheral portion of the solidified metal is greater due to the direct cooling effect given by the water-cooled core member, the solidified metal firmly clamps the core member so that cracks tend to occur in the inner peripheral portion, thereby disturbing smooth continuous casting operation. In order to avoid the above difficulty, the core member is so shaped that the outer peripheral surface is tapered downwardly inwardly so as to facilitate pulling out of the solidified metal downwardly from the casting passage. However, due to the tapered configuration of the core member, occurrence of sweating or cold shut in the inner peripheral surface of the solidified metal can not be avoided depending on the casting condition employed as the solidified metal is pulled out from the casting passage, thereby resulting in unevenness in the inner peripheral surface and making it impossible to obtain a smooth inner peripheral surface. Since a large amount of metal must be removed by scaling operation in order to remove the defects in the inner peripheral portion of the hollow ingot, the yield in production thereof is largely lowered. Thus, the defects in the inner peripheral portion of the hollow ingot afford severe problems to the production of the hollow ingot by continuous casting operation.

Further, since the molten metal supplying devices each having the level controllers are placed directly in the casting passage requiring substantial space therefor, the wall-thickness of the hollow ingot is limited to about 80 mm at the thinnest, thereby making it difficult to produce hollow ingot having a thinner wall-thickness. Further, by the apparatus having the core member with the outer peripheral surface thereof tapered downwardly inwardly, clearance might be formed between the tapered outer peripheral surface of the core member and the solidified shell formed by forcibly cooling in the inner peripheral portion of the solidified metal as the same is pulled out from the casting passage, thereby resulting in danger to cause leakage of the molten metal through the clearance so as to make it impossible to continue the casting.

In order to avoid the above described difficulty, efforts have been made to form the core member integrally as a whole by graphite so as to be able to cast the hollow ingot by suppressing the cooling effect at the inner peripheral portion. The graphite has a great heat capacity and a high thermal conductivity as well as a superior lubricating property. However, even though the core member is formed by the graphite, the formation of the solidified shell in the inner peripheral portion of the molten metal and the danger of leakage of the molten metal through the clearance formed between the tapered outer peripheral surface of the core member and the solidified shell as described above as the solidified metal is pulled out of the casting passage can not be avoided, because the heat capacity of the graphite forming the core member is great thereby resulting in a high initial cooling effect given by the core member. Further, even though the leakage of the molten metal through the clearance as described above be avoided as the solidified metal is pulled out from the casting passage, the great cooling effect of the core member made of graphite remains for a fairly long time, thereby resulting in great heat removing effect given to the molten metal, and the unevenness of the inner peripheral surface described previously can not be avoided so that the yield in casting is greatly deteriorated to prevent desirable continuous casting operation from being carried out. In order to avoid the above difficulty, however, preheating of the core member as well as the provision of heating means in the core member is practically difficult.

Further, since the molten metal supplying devices each having the level controllers are arranged directly in the casting passage formed between the mold and the core member, thin-walled hollow ingot can not be produced as described previously. It has been proposed to support the core member in the dipped state in the molten metal so as to provide a molten metal pool at the upper side of the core member and to arrange the molten metal supplying spout in the above molten metal pool. With such an arrangement, however, the solidification of the molten metal at the surface of the core member, particularly at the upper surface of the core member, is accelerated or expedited due to the great cooling effect of the core member because the rate of supply of the molten metal is rather little because of the hollow configuration of the ingot to be continuously cast. This tendency is rendered to be greater as the wall-thickness of the hollow ingot is made thinner, and as the diameter of the ingot is made larger. As a result, the hollow ingot thus cast can not be pulled out from the casting passage or the core member is forcibly pulled out together with the ingot sticking thereto, thereby tending to make it impossible to continue the casting operation. Further, the temperature of the molten metal tends to descend non-uniformly, thereby resulting in formation of floating crystals within the ingot so that the structure of the finished surface of the ingot after scalping operation is given thereto is made non-uniform resulting in the spotted or streaked finished surface of the product.

In order to avoid the above difficulties caused by the thermal property of the graphite forming the core member described above, it has been proposed to form the casting face on which the solidification of the molten metal is effected by a heat-insulating material. However, such a heat-insulating material has a deteriorated lubricating property in comparison with the graphite, thereby making it difficult to form a superior inner peripheral surface of the ingot. Further, since the mechanical strength of the heat-insulating material is low, it tends to be broken during the casting operation. Particularly, it is easily broken when the cooling water beats against it.

Further, it has also been proposed to provide a molten metal receiving vessel (a so called "Hot Top"), made of a refractory material on the annular water-cooled mold used for defining the outer peripheral surface of the hollow ingot to be cast, and to locate centrally in the inner space of the mold a core member used for defining the inner peripheral surface of the hollow ingot, so that the molten metal supplied to a molten level controller is introduced therefrom into the vessel through a molten metal distributing passage, thereby permitting the molten metal to be continuously supplied from the vessel into the casting passage from between the mold and the core member so as to carry out the continuous casting operation of the hollow ingot. In this case, when a plurality of sets of the above apparatus are provided in order to carry out simultaneously multiple casting operations, each water-cooled mold must be provided with a molten metal receiving vessel while at least a molten metal distributing passages must be provided leading from the level controller to each of the respective vessels, thereby not only making the overall construction of the apparatus complicated but also rendering the temperature of the molten metal supplied to the respective vessels and hence to the respective casting passages to be different from each other and even in such casting passage. Further, provision of a plurality of molten metal distributing passages for achieving the uniform temperature of the molten metal to each of the vessels will make the arrangement, configuration and the number of the distributing passages very difficult. In other words, the workability and the productivity of the hollow ingot by the continuous casting operation are deteriorated, and the production of ingots of a high quality is made difficult. When the temperature is made non-uniform, floating crystals are formed in the ingot as described previously, and the structure of the finished surface of the ingot after cutting out the defects in the surface of the ingot is made non-uniform, resulting in spotted and streaked appearance.

OBJECT OF THE INVENTION

It is the object of the present invention to provide a novel and useful apparatus for continuously casting a thin-walled hollow metallic ingot of a high quality without suffering from defects, particularly in the inner peripheral surface of the ingot, having a large diameter and a cross-section in the circular, rectangular or a relatively simple closed loop form difficult to be cast by the prior art apparatus for continuously casting a hollow metallic billet, wherein the above described difficulties arising in the prior art apparatus are positively avoided.

SUMMARY OF THE INVENTION

The above object is achieved in accordance with the characteristic feature of the present invention by the provision of an apparatus for continuously producing an elongated hollow metallic billet having a cross-section in the form of the circular or other closed loop form, including an annular water-cooled metallic mold having an open upper end and an open lower end with the cross-section of the inner periphery thereof being so shaped as to correspond to that of the outer periphery of the hollow metallic ingot, a core member located within the inner space of the mold with the cross-section of the outer periphery thereof being so shaped as to correspond to that of the inner periphery of the hollow metallic ingot, thereby forming together with the mold an annular casting passage therebetween which is adapted to pass therethrough molten metal supplied thereinto from the open upper end for continuously causing solidification of the molten metal between the open upper end and the open lower end of the casting passage so as to produce the hollow metallic ingot, and a movable supporting base member adapted to be initially so located as to close the open lower end of the casting passage for supporting the molten metal supplied in the casting passage thereon and then to be gradually lowered apart from the open lower end so as to pull out the solidified metal supported thereon as the solidification of the molten metal continuously proceeds, while the molten metal is continuously supplied into the casting passage so as to compensate for the amount of metal solidified and pulled out from the casting passage, thereby permitting the hollow metallic ingot to be continuously produced, the solidification point of the molten metal within the casting passage being maintained substantially within the range between the open upper and lower ends of the casting passage, the apparatus being characterized by the core member comprising a heat-insulating member made of a heat insulating material and having a molten metal receiving vessel integrally mounted thereon and being formed with at least one molten metal conducting passage communicating with the casting passage for receiving therein the molten metal supplied thereinto and supplying the same therefrom into the casting passage through the molten metal conducting passage as the solidified metal is pulled out from the casting passage, the vessel being provided with means for maintaining the level of the molten metal in the vessel substantially constant, and a casting member made of graphite or a carbonic material and secured to the lower side of the heat-insulating member with the outer peripheral surface being tapered toward downwardly and extending by an appropriate range within which the solidification commencing point is located at an appropriate position so as to form a casting face of the core member.

With the apparatus constructed in accordance with the present invention described as above, the solidification of the molten metal supplied in the casting passage commences first at the outer surface thereof and proceeds inwardly and finally to the inner surface of the molten metal, thereby positively avoiding formation of solidified shell in the inner peripheral surface and occurrence of sweating as well as cold shut and thereby achieving a high quality of the inner peripheral surface of the billet thus cast because the heat-insulating member has the effect of slowing down the cooling and solidifying rate at the inner peripheral portion of the molten metal while the outer peripheral portion is quickly cooled and solidified by the effect of the water-cooled mold.

The casting member may be made in the form of a thin-walled hollow member extending along the direction in which the solidified metal is pulled out or, alternatively, it may be made in the form of a thin-walled cup with the open upper edge being secured to the lower side of said heat-insulating member, and a heat-insulating material may be filled in the inner space of the thin-walled hollow member or in the inner space of the thin-walled cup in order to improve the cooling rate of the casting member.

Further, in accordance with another feature of the present invention, the heat insulating member may have an outer peripheral edge portion extending outwardly a short distance beyond the outer peripheral edge portion of the casting member so as to project into the casting passage. The outer peripheral edge of the heat-insulating member may be beveled downwardly inwardly, or it may be rounded off downwardly so as not to interface with the solidification of the molten metal within the casting passage.

In accordance with a further feature of the present invention, another heat-insulating member made of a heat-insulating material may be provided on at least the upper portion of the inner peripheral surface of the water-cooled mold, the inner peripheral edge of the another heat-insulating member projecting inwardly into the casting passage beyond the inner peripheral surface of the mold. Further, another casting member made of graphite or a carbonic material may be provided in an annular recess formed in the lower portion of the inner peripheral surface of the another heat-insulating member, the inner peripheral surface of the another casting member being positioned outwardly a short distance beyond the upper inwardly projecting shoulder of the recess and being tapered downwardly outwardly so as to form the casting face of the mold.

With this arrangement of the apparatus, the sodification commencing point can be located sufficiently below the level of the molten metal in the casting passage to permit the space for locating the float of the level controller to be obtained on the upper side of the heat-insulating member.

Finally, in accordance with the present invention, another water-cooled metallic mold may be provided which is secured to the lower side of the heat-insulating member around which the core member is located with another heat-insulating member being interposed therebetween.

With this arrangement of the apparatus of the present invention, the inner peripheral surface of the solidified and pulled out metal from the casting passage may be relatively rapidly cooled by the cooling water discharged from the another water-cooled mold, thereby expediting the formation of the hollow ingot while the direct transmission of cold from the mold to the molten metal in the casting passage is avoided by virtue of the heat-insulating material interposed between the casting member and the another water-cooled mold, thereby positively avoiding the formation of solidified shell in the inner peripheral portion of the molten metal in the casting passage as well as the occurrence of the sweating and the cold shut in like manner as described previously. The cooling water from the another water-cooled mold, however, may be discharged without heating against the inner peripheral surface of the ingot pulled out from the casting passage, if desired. The selection as to whether or not the cooling water is directed to the inner peripheral surface of the ingot is dependent upon the position of the solidification commencing point of the molten metal in the casting passage, which is influenced by the cooling rate of the inner peripheral portion of the ingot together with the effect of the velocity of pulling out the solidified metal from the casting passage.

BRIEF DESCRIPTION OF THE DRAWINGS

The present invention will be described hereinbelow with reference to the accompanying drawings, illustrating the preferred embodiments of the apparatus of the present invention, in which.

DETAILED DESCRIPTION OF THE PREFERRED EMBODIMENTS

Figure 1:
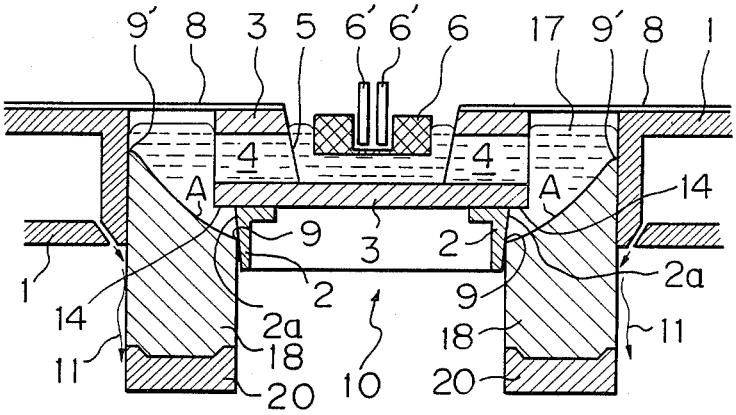
FIG. 1 is a cross-sectional view showing a first embodiment of the apparatus constructed in accordance with the present invention for continuously casting a hollow metallic ingot having the cross-section of the circular form.

Referring to FIG. 1, it shows the apparatus for continuously casting the cylindrical hollow material ingot 18 such as aluminum alloy constructed in accordance with the present invention. The billet 18 may have a cross-section in the rectangular form or in the relatively simple loop form other than the circular form.

The apparatus comprises an annular open ended water-cooled mold 1 and a core member 10 located centrally in the inner space of the mold 1 and supported by a supporting member 8 which is secured to the mold 1, so that an annular space forming the casting passage for the ingot 18 is formed between the mold 1 and the core member 10. As described later in detail, the molten metal supplied into the upper end of the casting passage gradually descends toward the lower end of the casting passage, and solidification of the molten metal commences at a point intermediate the upper and lower ends of the casting passage. A vertically movable annular supporting base member or a cradle 20 having the cross-section corresponding to that of the lower end of the casting passage is arranged beneath the lower end of the casting passage. As is well known in the art, the base member 20 is so located in its raised position at the beginning of the continuous casting operation that it closes the lower end of the casting passage so as to support the molten metal supplied into the casting passage preventing the leakage of the molten metal through between the lower end of the casting passage and the base member 20*c*. The base member 20 is held in the raised position until the lower portion of the molten metal 17 supplied in the casting passage solidifies. After the lower portion of the molten metal 17 has solidified, the base member 20 is gradually lowered so as to pull out the solidified metal from the lower end of the casting passage together with the base member 20, while the molten metal 17 is supplied into the upper end of the casting passage so as to supplement the amount of the metal pulled out of the casting passage. The upper surface A of the solidified metal is maintained at a predetermined level in the steady state in the annular space between the mold 1 and the core member 10 as shown in FIG. 1 by the appropriate conditions given by the present invention to the apparatus as described below.

In accordance with the characteristic feature of the present invention, the core member 10 comprises a heat-insulating member 3 constituting the main part of the core member 10 and supported by the mold 1 through the supporting member 8 and a casting member 2 having a casting face 2*a* formed in the outer peripheral surface thereof and fixedly secured to the lower side of the heat-insulating member 3. The casting member 2 is made of graphite or a carbonic material, and the casting face 2*a* is tapered downwardly inwardly and extends downwardly to an appropriate extent so that the solidification commencing point 9 of the molten metal at the side of the core member 10 is positioned at an appropriate point between the upper end and the lower end of the casting face 2*a* as shown in FIG. 1. The casting member 2 shown in FIG. 1 has a thin-walled cylindrical portion having the casting face 2*a* on the outer peripheral surface thereof and an inwardly extending flange formed at the upper end of the cylindrical portion for securing the casting member 2 to the lower side of the heat-insulating member 3. The casting member, however, may be formed as a hollow cylindrical member 2' having no flange as shown in FIG. 1*a*.

Figure 1A:
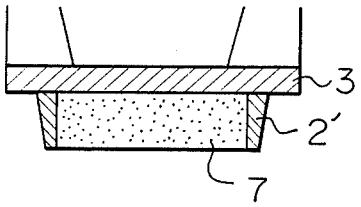
FIG. 1*a* is a fragmentary cross-sectional view showing the manner in which a heat-insulating material is filled in the space in the casting member of the cylindrical shape.
Figure 1B:
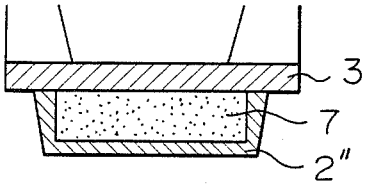
FIG. 1*b* is a fragmentary cross-sectional view similar to FIG. 1*a* but showing the manner in which a heat-insulating material is filled in the space in the casting member of the cup form.

Alternatively, the casting member 2 or 2' may be provided with a heat-insulating material 7 filled in the inner space of the casting member as shown in FIG. 1*a*, or the casting member be formed as a cup-shaped member 2'' with the upper open end fixedly secured to the lower side of the heat-insulating member 3 as shown in FIG. 1*b* and the heat-insulating material 7 may be filled in the inner space of the cup-shaped member 2''.

The heat-insulating member 3 is preferably made of a heat-insulating material such as Marilite (Tradename) manufactured and sold by Asahi Sekimen Kabushikikaisha, Marinite (Tradename) manufactured and sold by John Manville Kabushikikaisha and Massrock (Tradename) manufactured and sold by Toshiba Moflux Kabushikikaisha or the like.

The heat-insulating member 3 has a molten metal receiving vessel 5 integrally formed on the heat-insulating member 3 for temporarily receiving the molten metal 17 therein the supplying the molten metal received in the vessel 5 to the upper end of the casting passage. To this end, the vessel 5 is formed with at least one horizontal molten metal conducting passages 4 (in the embodiment shown, four horizontal passages 4 are provided extending radially at an angle of 90° formed between the adjacent two passages 4) leading from the interior of the vessel 5 to the upper end of the casting passage. Provision of a plurality of radially extending horizontal passages 4 is preferable, because they serve to maintain the temperature of the molten metal 17 supplied to the casting passage substantially constant. The passages 4 may be made in the form of open ended grooves.

In order to maintain the level of the molten metal 17 in the vessel 5, and hence, in the casting passage, a molten metal supplying device with molten metal level controller is provided in the vessel 5, the level controller consisting of a float 6 and at least one dip tube 6' for maintaining the level of the molten metal 17 supplied through the dip tube 6' constant as previously described in connection with the prior art continuous casting apparatus.

Figure 1C:
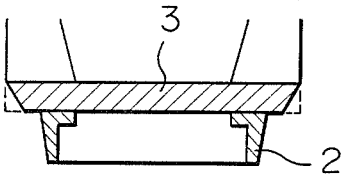
FIG. 1*c* is a fragmentary cross-sectional view showing the beveled edge of the heat-insulating member to which the casting member is fixedly secured at the lower side thereof, the beveled edge extending a short distance beyond the outer peripheral edge of the casting member.

As described above, since the molten metal supplying device comprising the vessel 5, the passages 4, the float 6 and the dip tubes 6' is located centrally of the casting passage and not located directly in the casting passage as is the case of the prior art, the thickness of the annular casting passage can be greatly reduced in comparison with the prior art, thereby permitting a hollow ingot 18 having a very thin wall-thickness, particularly less than 80 mm, to be continuously cast, while the temperature of the molten metal 17 supplied in the casting passage is held uniformly along the entire circumference of the upper end of the casting passage to insure a high quality of the cast ingot 18 without having defects such as floating crystals within the interior of the wall of the ingot 18. As shown in FIG. 1, the lower edge of the outer peripheral portion 14 of the heat-insulating member 3 extends outwardly a short distance beyond the outer periphery of the casting member 2 along the entire circumference so as to project into the casting passage. The extended peripheral portion 14 of the heat-insulating member 3 may be beveled downwardly inwardly as shown in FIG. 1*c*, or, alternatively, it may be rounded off downwardly inwardly. The beveled or rounded-off edge of the extended peripheral portion 14 of the heat-insulating member 3 is preferable in avoiding the interference thereof with the upper surface A of the solidified metal.

By virtue of the provision of the extended peripheral portion 14, it can be positively avoided that the solidified metal firmly sticks to the casting member 2 and forcibly moves it downwardly together with the solidified metal as the base member 20 descends so that the casting member 2 is removed from the heat-insulating member 3.

In other words, the provision of the extended peripheral portion 14 makes it possible to positively avoid the occurrence of a strong force tending to cause removal or stripping off of the casting member 2 from the heat-insulating member 3 due to breakage of the latter which might take place should the solidification commencing point enter the region of the heat-insulating member 3, thereby causing leakage of the molten metal.

In casting operation of the apparatus of the present invention described above, the annular base member 20 is first positioned to close the lower end of the casting passage defined by the water-cooled mold 1 and the core member 10. The base member 20 is inserted upwardly into the lower end of the casting passage to hermetically close the lower end of the casting passage to prevent the molten metal 17 from leaking through between the casting passage and the base member 20. Thereafter, the molten metal 17 is supplied from the dip tubes 6' into the molten metal receiving vessel 5 and is then supplied to the upper end of the casting passage through the molten metal conducting passage 4, while the level of the molten metal 17 is maintained constant by the action of the float 6 controlling the supply of the molten metal 17 from the dip tubes 6' depending upon the level of the molten metal in the vessel 5.

The molten metal 17 supplied into the casting passage is first cooled mainly by the water-cooled mold 1 and the cold given by the base member 20 closing the lower end of the casting passage and is also cooled by the casting member 2 while the heat-insulating member 3 is not effective for the cooling. However, upon commencing the casting operation, the casting member 2 is immediately heated by the molten metal 17 so that the cooling effect of the casting member 2 is lost. Therefore, the upper surface A of the solidified metal tends to be so configured that the outer peripheral portion of the surface A at the side of the mold 1 is higher than the inner peripheral portion at the side of the casting member 2 as shown in FIG. 1.

In order to maintain the level of the solidification commencing point 9 at the inner peripheral surface of the solidified metal 18 in the casting passage at an appropriate position intermediate the height of the casting member 2 shown in FIG. 1, the time of commencing the downward movement of the base member 20 and the velocity of the downward movement thereof are so set that the descending movement is commenced when the solidification commencing point 9 reaches about the position shown in FIG. 1, and this position is maintained during the continued casting operation. Such setting and controlling of the operating condition are determined by the theoretical calculation and a number of trials and experiments. As the solidified metal 18 is pulled out of the casting passage together with the base member 20, the molten metal 17 is supplied through the dip tubes 6' into the vessel 5 so as to supplement the amount of the metal removed from the casting passage, the level of the molten metal 17 in the casting passage being maintained by the action of the float 6. The molten metal 17 in the casting passage after the base member 20 is moved downwardly is cooled mainly by the water-cooled. The viass of the solidified metal 18 pulled out of the casting passage and cooled by the cooling water 11 discharged from the mold 1 as shown in FIG. 1. Under these conditions, the casting operation is continuously carried out.

Since the core member 10 consists of a casting member 2 of graphite and a heat-insulating member 3 in accordance with the present invention, the initial cooling effect to the molten metal at the inner peripheral surface thereof is afforded mainly by the casting member 2, the heat-insulating member 3 being non-effective to the cooling. Therefore, the undesired thermal influence resulting in formation of solidified shell and occurrence of sweating or cold shut at the inner peripheral surface in a fairly long portion of the initially solidified metal can be positively avoided. Further, since the wall-thickness of the graphite of the casting member 2 is made thin so as to reduce the heat capacity thereof, the temperature of the casting member 2 rises sufficiently during the time of the initial cooling of the molten metal by the water-cooled mold 1 in cooperation with the base member 20. Therefore, the casting member 2 is rendered to be substantially non-effective to cool the inner peripheral surface of the molten metal, thereby positively avoiding the formation of solidified shell and the occurrence of the sweating and cold shut at the inner peripheral surface so as to achieve the superior quality of the inner peripheral portion of the cast hollow ingot, while the leakage of the molten metal 17 is positively prevented, because the heat-extraction at the inner peripheral surface from the casting member 2 therewithin is avoided.

In order to reduce the heat capacity of the casting member 2 as low as possible, the longitudinal or vertical cross-sectional area thereof must be limited to about equal to or lower than 1000 $mm^2$, preferably equal to or lower than 500 $mm^2$. Therefore, the configuration of the casting member 2 in the form of a thin-walled hollow member is preferred. Further, in order to suppress the dissipation of heat from the casting member 2, the previously mentioned heat-insulating material 7 is preferably filled in the inner space of the hollow casting member 2, thereby permitting the effect for preventing the occurrence of uneven surface or the spotted surface in the inner periphery of the solidified metal to be further enhanced.

In continuing the casting operation in the steady state, the position of the upper surface A of the solidified metal 18 is determined by appropriately selecting the supply rate of the cooling water and the descending speed of the base member 20.

In the continuous casting of aluminum alloy, the occurrence of the unevenness of the inner peripheral surface of the solidified aluminum alloy is in general remarkable until the temperature of the casting face 2*a* of the casting member 2 adjacent to the solidification commencing point 9 reaches about the melting point of the aluminum alloy or higher than that. However, since the heat capacity of the casting member 2 made of graphite or a carbonic material is suppressed as low as possible, the temperature of the casting face 2*a* adjacent to the solidification point 9 will soon rise and reach about the melting point of the aluminum alloy or higher, thereby permitting the occurrence of the unevenness of the inner peripheral surface of the solidified portion to be positively prevented while leakage of the molten aluminum alloy is avoided. At the same time, firm damping of the core member 10 by the quickly solidified aluminum alloy due to rapid cooling is largely avoided to insure continued casting operation while previously described troubles tending to occur in the prior art apparatus are positively avoided. Therefore, a high quality of the inner peripheral surface and the uniform structure of the cast hollow ingot are insured immediately after the casting operation commences.

In summary, the present invention makes it possible to commence the solidification of the molten metal in the casting passage first at the outer peripheral surface contacting with the water-cooled mold 1 as well as at the portion contacting with the base member 20. The solidification proceeds inwardly of the mass of the molten metal and finally reaches the inner peripheral surface contacting with the casting face 2*a*. Therefore, since the molten metal in the casting passage is subjected to constraint solely by the solidified shells formed at the outer peripheral and bottom surfaces contacting with the water-cooled mold 1 and the base member 20, formation of cracks in the interior of the solidified metal is positively avoided, thereby permitting the casting operation to be continued at a casting velocity equal to or higher than twice as high as the casting velocity heretofore possible in the prior art continuous casting apparatus without causing cracks in the solidified metal.

Figure 2:
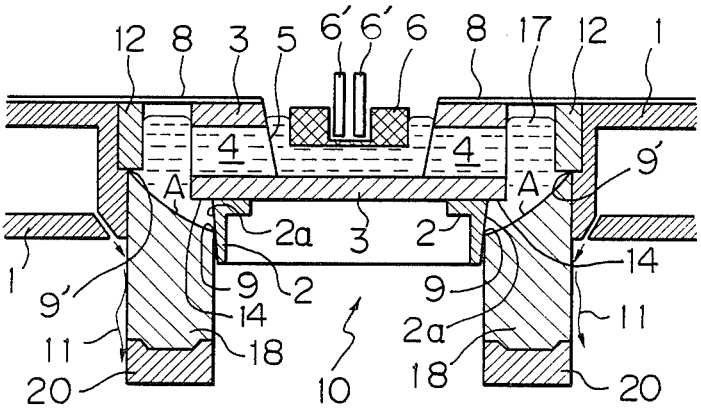
FIG. 2 is a cross-sectional view similar to FIG. 1 but showing a second embodiment of the present invention in which another heat-insulating member is attached to the upper portion of the inner peripheral surface of the water-cooled mold for lowering the solidification commencing point adjacent to the inner peripheral surface of the mold.

FIG. 2 shows a modified embodiment of FIG. 1 in which another annular heat-insulating member 12 is secured to an annular recess formed in the upper portion of the inner peripheral surface of the water-cooled mold 1. This embodiment is advantageous particularly in continuously casting a thin-walled hollow ingot 18. In FIG. 1, the solidification commencing point 9' at the outer peripheral surface of the solidified metal is positioned rather shortly below the level of the molten metal 17. Therefore, if a thin-walled hollow ingot is to be cast by such an arrangement as shown in FIG. 1, the solidification commencing point 9 at the inner peripheral surface of the solidified metal at the side of the core member 10 will be shifted further upwardly as the wall-thickness is made thinner, thereby rendering the space for arranging the float 6 therein to be narrowed so that it is made difficult to locate the flat 6 in order to properly supply the molten metal to the casting passage. The arrangement of FIG. 2 solves the above described difficulty by lowering the upper surface A of the solidified metal 18 in the casting passage because of the provision of the heat-insulating member 12. The heat-insulating member 12 suppress the cooling of the molten metal 17 contacting therewith and is not effective to cool the same so that the solidification of the molten metal 17 at the outer peripheral surface thereof commences at the point 9' on the inner peripheral surface of the mold 1 immediately below the lower end of the heat-insulating member 12, and the solidification of the molten metal 17 proceeds toward the interior of the mass of the molten metal 17 and downwardly to the solidification commencing point 9 at the inner peripheral surface thereof as shown in FIG. 2 so that the upper surface A of the solidified metal 18 sufficiently descends, thereby providing sufficient space for locating the float 6 in an appropriate condition to enable a thin-walled hollow ingot 18 having the wall-thickness equal to or less than 20 mm to be continuously cast. The heat-insulating member 12 may be made of the same heat-insulating material as that forming the heat-insulating member 3. Of course, it may be formed by other heat-insulating material than the above described heat-insulating material.

Figure 3:
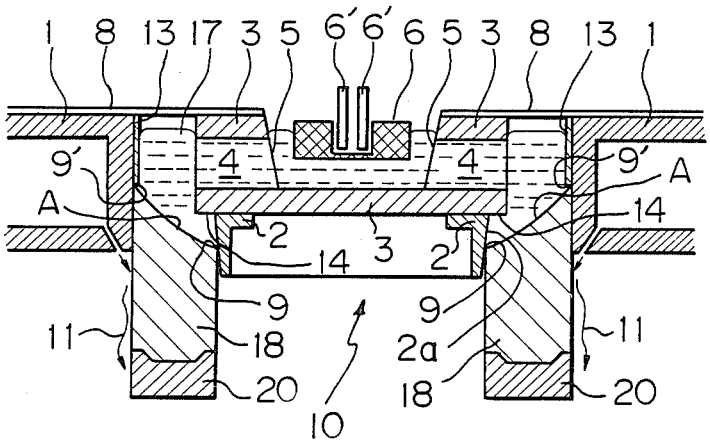
FIG. 3 is a cross-sectional view showing a modified form of the embodiment shown in FIG. 2 in which a heat-insulating pad is secured to the upper portion of the inner peripheral surface of the water-cooled mold in place of the another heat-insulating member shown in FIG. 2.

Alternatively, the heat-insulating member 12 may be replaced by a relatively thin heat-insulating pad 13 fixedly attached to the upper portion of the inner peripheral surface of the water-cooled mold 1 without forming an annular recess in the upper portion of the inner peripheral surface thereof as shown in FIG. 3 without deteriorating the effectiveness. The heat-insulating pad 13 may be made by Fiberflux Paper (Tradename) manufactured and sold by Toshiba Monoflux Co., Ltd.

Figure 4:
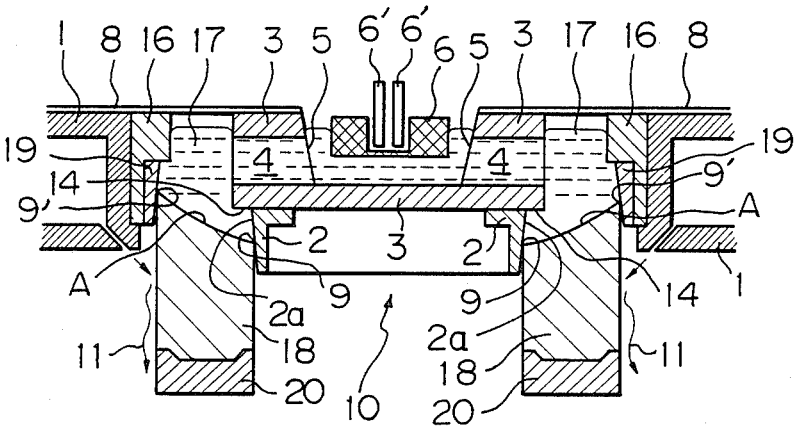
FIG. 4 is a cross-sectional view similar to FIG. 2 but showing another casting member attached to the lower portion of the another heat-insulating member shown in FIG. 2.

FIG. 4 shows a further modification of the embodiment of FIG. 2 in which another annular casting face member 19 made of graphite or a carbonic material is mounted on the inner peripheral surface of the heat-insulating member 16 similar to the heat-insulating member 12 of FIG. 2 as shown, the inner peripheral surface of the casting face member 19 being preferably tapered so as to enlarge the inner diameter toward downwardly to form a casting face acting in the same manner as that of the casting face 2*a* of the casting member 2. In this embodiment, the outer peripheral surface of the molten metal 17 in the casting passage is not subjected to forcible cooling by the water-cooled mold 1. Therefore, with the apparatus shown in FIG. 4, formation of solidified shell and layer of inverse segregation and occurrence of sweating and cold shut are prevented also in the outer peripheral surface of the cast hollow ingot 18 to insure a high quality of a hollow ingot all over the entire surfaces thereof.

Figure 5:
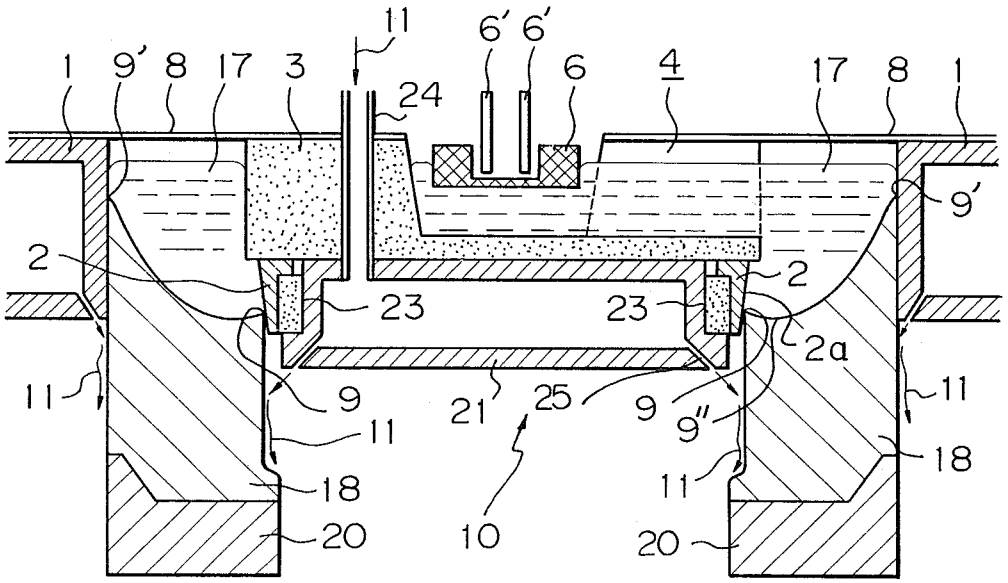
FIG. 5 is a cross-sectional view showing a third embodiment of the apparatus of the present invention in which another water-cooled mold is provided which is fixedly secured to the lower side of the heat-insulating member, the casting member being positioned around the another water-cooled mold with another heat-insulating member being interposed therebetween.

FIG. 5 shows a third embodiment of the apparatus of the present invention. The embodiment shown comprises another water cooled mold 21 secured to the lower side of the heat-insulating member 3 in the inner space of the casting member 2 with another heat-insulating member 23 interposed therebetween. The cooling water 11 is introduced in the mold 21 through a pipe 24 passing through the heat-insulating member 3 and discharged through a plurality of discharge openings 25 formed in spaced relationship from each other around the periphery of the lower end so as to be injected to the inner peripheral surface of the ingot 18 pulled out from the casting passage for cooling the same. Thus, the water-cooled mold 21 is not effective to directly cool the casting member 2 by the interposition of the heat-insulating member 23 so as to achieve the effectiveness of the casting member 2 previously described, but the cooling water discharged from the openings 25 cools the inner peripheral surface of the ingot 18 so that the cooling of the ingot 18 is a little expedited. Of course, the cooling water 11 discharged from the mold 21 may be directed vertically downwardly without being injected to the inner peripheral surface of the ingot 18 if desired. The selection of direction of the flow of the cooling water is dependent upon the operating conditions for maintaining the position of the solidification commencing point 9 at the inner peripheral surface of the solidified metal 18 at an appropriate position within the range of the casting face 2*a* between the upper end and the lower end of the casting member 2.

In the embodiment shown in FIG. 5, the inner peripheral surface of the base member 20 is adapted to be closely contacted with the outer peripheral surface of the mold 21 so as to prevent the leakage of the molten metal. Thus, during a short time period at the beginning of the casting operation, the solidification commencing point 9 is positioned on the outer peripheral surface of the mold 21. However, as the solidified metal is pulled out of the casting passage and the inner peripheral surface thereof is cooled by the cooling water 11 discharged from the openings 25, the solidification commencing point 9 is rapidly shifted upwardly so as to be positioned in the range of the casting face 2*a* of the casting member 2 and maintained thereat in the steady state by appropriately selecting the discharge rate of the cooling water 11 and the pull-out velocity of the solidified ingot 18.

The embodiment shown in FIG. 5 comprises a water-cooled mold 21 and insures the prevention of initial leakage of the molten metal in the case of a hollow ingot having a relatively great wall-thickness such as equal to or greater than 60 mm, while the height or the longitudinal length of the core member can be shortened, because the solidification commencing point 9 will be displaced upwardly due to the cooling effect by the mold 21.

Further, the mold 21 may be used in combination with the apparatus shown in FIGS. 2–4 without causing cracks in the interior of the wall of the hollow ingot but insuring the smooth inner peripheral surface thereof, insofar as the position of the solidification point 9 at the inner peripheral surface of the solidified metal is controlled so as to be located sufficiently below the solidification commencing point 9' at the outer peripheral surface, and insofar as the solidification of the metal adjacent to the lowest point 9'' in the upper surface A of the solidified metal 18 is not strongly affected by the constraint given by the solidified shell formed at the solidification commencing point 9 in the inner peripheral surface of the solidified metal 18, even though the point 9'' is a little lower than the point 9.

In the present invention, the casting member 2 may be formed by a material such as SiC, $Si_3N_4$ and the like instead of graphite or a carbonic material. In consideration of the thermal impact resisting property desired to be given to the casting member 2, however, graphite or a carbonic material is preferable. The lubricating property of the casting member 2 made of graphite or a carbonic material can be improved by spraying the surface thereof with boron nitride powder, carbon powder, carbon black powder, molybdenum bisulfide powder and the like or applying to the surface thereof the above powder mixed with wax.

Since the apparatus of the present invention is provided with a molten metal receiving vessel arranged above the core member and not in the casting passage and the number of the molten metal conducting passages can be increased as desired, it will be understood that the temperature of the molten metal supplied to the annular casting passage can be made uniform along the entire circumference, while a thin-walled hollow ingot having a large diameter such as equal to or greater than 800 mm can be continuously cast.

EXAMPLE 1

Using an apparatus as shown in FIG. 1 having a metallic water-cooled mold 1 having the inner diameter of 288 mm, a casting member 2 having the outer diameter of 190 mm at the upper end and the casting face 2*a* of the taper angle of 9° (the diameter reduced toward downwardly), and a heat-insulating member 3 having the outer diameter of 200 mm and a molten metal receiving vessel 5 located thereon with four radially extending molten metal conducting passages 4 of 20 mm diameter angularly spaced from each other by 90° (the vessel 5 being made of Marilite previously described), and using the aluminum alloy of JIS A 6063 as the casting metal, a continuous casting operation was carried out at the casting velocity of 100 mm/min and the flow rate of the cooling water of 140 liters/min.

The result has proved that a hollow ingot having a very smooth inner peripheral surface has been obtained with a high reproductivity except the initially cast portion of about 80 mm at the beginning of the casting operation.

As a comparison test, a continuous casting operation was carried out under the same conditions as described above except that a solid core member 10 made of graphite without a hollow space formed therein was used in place of the hollow core member.

The results showed that the initially cast portion of the hollow ingot of about 450 mm length had a very uneven inner peripheral surface as well as defects in the interior of the wall of the hollow ingot. Further, solidification of the metal occurred in the molten metal conducting passages 4 because of too high cooling effect given by the core member at the beginning of the casting operation and, thus, the pulling out the solidified metal by descending the base member 20 was frequently made impossible.

EXAMPLE 2

Using an apparatus comprising a water-cooled mold 1 having the inner diameter of 180 mm with an annular recess being formed in the upper portion of the inner peripheral surface in which a heat-insulating member 12 (FIG. 2) of the inner diameter of 170 mm and the thickness of 40 mm made of Marilite produced by Asahi Sekimen Co., Ltd. is attached so as to project inwardly beyond the inner peripheral surface of the mold 1, a casting member 2 having the outer diameter of 130 mm at the upper end thereof with the casting face 2*a* being tapered by a taper angle of 7° and a core member 10 made of Marilite made of Asahi Sekimen Co., Ltd. and having a molten metal receiving vessel 5 located on the upper surface thereof with four molten metal conducting grooves 4 of the V-shaped cross-section having the width of 20 mm formed therein, continuous casting operation was carried out by using aluminum alloy of JIS A 5056 under the conditions of the casting velocity of 180 mm/min and the flow rate of the cooling water of 100 liters/min. The results proved that a hollow ingot of the wall-thickness of about 24 mm having a very smooth inner peripheral surface was obtained with a high reproductivity.

EXAMPLE 3

Using an apparatus comprising a water-cooled mold 1 having the inner diameter of 280 mm with an annular recess being formed in the upper portion of the inner peripheral surface thereof in which an annular heat-insulating member 16 (FIG. 4) made of Marilite produced by Asahi Sekimen Co., Ltd. is secured, the heat-insulating member 16 being in turn formed with an annular recess in the lower portion of the inner peripheral surface thereof in which a casting member 19 of graphite having the inner diameter of 278 mm at the lower end with the inner peripheral casting face thereof being tapered by a taper angle of 3° (the diameter reduced toward upwardly), and a casting member 2 having the outer diameter of 190 mm at the upper end thereof with the casting face 2*a* thereof being tapered by a taper angle of 9° (the diameter reduced toward downwardly), and a heat insulating member 3 of Marilite produced by Asahi Sekimen Co., Ltd. having the outer diameter of 200 mm and secured to the upper surface of the casting member 2 and having a molten metal receiving vessel 5 integrally formed thereon in which four molten metal conducting grooves 4 of the V-shaped cross-section of the width of 40 mm are formed, a continuous casting operation was carried out by using the aluminum alloy of JIS A 6063 under the casting conditions of the casting velocity of 90 mm/min and the flow rate of the cooling water of 180 liters/min. The results proved that a hollow ingot having the very smooth inner peripheral surface but without formation of solidified shell and ingot segregation layer adjacent to the outer peripheral surface was obtained with a high reproductivity.

As described above, the present invention has very superior effectiveness as follows:

(1) A high quality hollow ingot having a very smooth and sound inner peripheral surface but without cracks and other defects in the interior of the wall of the ingot can be continuously cast.

(2) Smooth casting operation can be commenced without causing leakage of the molten metal at the beginning of the casting operation.

(3) Sound hollow ingot can be obtained quickly after beginning of the casting operation.

(4) A thin-walled hollow ingot having the wall-thickness in the range of about 10–80 mm and yet having the outer diameter equal to or greater than 800 mm can be continuously cast, such being impossible by the prior art casting apparatus.

(5) Since the molten metal receiving vessel is located above the core member centrally of the casting passage and the molten metal is supplied radially therefrom to the casting passage located around the vessel through the conducting passages, uniform temperature of the molten metal supplied to the casting passage is insured so that a high quality hollow ingot can be cast at a high productivity.

(6) The casting apparatus of the present invention is inexpensive to construct and easy in maintenance.

What is claimed is:

1. An apparatus for continuously producing an elongated hollow metallic ingot having a cross-section in the form of a circle or other closed loop form, said apparatus comprising:

(a) an annular water-cooled metallic mold having an open upper end and an open lower end with the cross-section of the inner periphery thereof being so shaped as to correspond to that of the outer periphery of the hollow metallic ingot;

(b) a core member located within the inner space of said mold with the cross-section of the outer periphery thereof being so shaped as to correspond to that of the inner periphery of the hollow metallic ingot, thereby forming together with said mold a casting passage therebetween which is adapted to pass therethrough molten metal supplied thereinto from said open upper end for continuously causing solidification of the molten metal between the open upper end and the open lower end of said casting passage so as to produce the hollow metallic ingot; and (c) a movable supporting base member adapted to be initially so located as to close said open lower end of said casting passage for supporting the molten metal supplied in said casting passage thereon and then to be gradually lowered away from said open lower end so as to pull out the solidified metal supported thereon as the solidification of the molten metal continuously proceeds, while the molten metal is continuously supplied into said casting passage so as to compensate for the amount of metal solidified and pulled out from said casting passage, thereby permitting said hollow metallic ingot to be continuously produced, the solidification point of the molten metal within said casting passage being maintained substantially within the range between said open upper and lower ends of said casting passage;

(d) said core member comprising:

(i) a heat-insulating member:

(A) made of a heat insulating material;

(B) having a molten metal receiving vessel integrally formed therein;

(C) being formed with at least one molten metal conducting passage communicating said molten metal receiving vessel with said casting passage for supplying the molten metal from said vessel into said casting passage; and (D) having a planar bottom surface;

(ii) a casting member:

(A) made of graphite or a carbonic material;

(B) having a planar top surface secured to the planar bottom surface of said heat-insulating member;

(C) comprising a thin-walled hollow portion extending along the direction in which the solidified metal is pulled out;

(D) the outer peripheral surface of which is tapered downwardly and inwardly and which extends by an appropriate range within which the solidification commencing point is located at an appropriate position so as to form a casting face of said core member; and (E) the top edge of the outer peripheral surface of which joins the planar top surface of said casting member and is spaced inwardly of the lower edge of the planar bottom surface of said heat-insulating member, whereby an inwardly extending, downwardly facing planar ledge is formed at the interface of said heat-insulating member and said casting member and above the solidification commencing point;

(iii) a molten metal supplying device including a molten metal level controller located in said molten metal receiving vessel, said molten metal level controller comprising a float and at least one dip tube arranged to maintain the level of the molten metal in said molten metal receiving vessel constant;

(e) said heat-insulating member having an outer peripheral edge portion extending outwardly a short distance beyond the outer peripheral edge portion of said casting member so as to project into said casting passage.

2. An apparatus for continuously producing an elongated hollow metallic ingot having a cross-section in the form of a circle or other closed loop form, said apparatus comprising:

(a) an annular water-cooled metallic mold having an open upper end and an open lower end with the cross-section of the inner periphery thereof being so shaped as to correspond to that of the outer periphery of a hollow metallic ingot;

(b) a core member located within the inner space of said mold with the cross-section of the outer periphery thereof being so shaped as to correspond to that of the inner periphery of the hollow metallic ingot, thereby forming together with said mold a casing passage therebetween which is adapted to pass therethrough molten metal supplied therein to from said open upper end for continuously causing solidification of the molten metal between the open upper end and the open lower end of said casting passage so as to produce the hollow metallic ingot; and (c) a movable supporting base member adapted to be initially so located as to close said open lower end of said casting passage for supporting the molten metal supplied in said casting passage thereon and then to be gradually lowered away from said open lower end so as to pull out the solidified metal supported thereon as the solidification of the molten metal continuously proceeds, while the molten metal is continuously supplied into said casting passage so as to compensate for the amount of said metal solidified and pulled out from said casting passage, thereby permitting the hollow metallic ingot to be continuously produced, the solidification point of the molten petal within said casting passage being maintained substantially within the range between said open upper and lower ends of said casting passage;

(d) said core member comprising:

(i) a heat-insulating member:

(A) made of a heat insulating material (B) having a molten metal receiving vessel integrally formed therein;

(C) being formed with at least one molten metal conducting passage communicating said molten metal receiving vessel with said casting passage for supplying the molten metal from said vessel into said casting passage; and (D) having a planar bottom surface;

(ii) a casting member:

(A) made of graphite or a carbonic material;

(B) having a planar top surface secured to the planar bottom surface of said heat-insulating member;

(C) the outer peripheral surface of which is tapered downwardly and inwardly and which extends by an appropriate range within which the solidification commencing plate is located at an appropriate position so as to form a casting face of said core member;

(D) the top edge of the outer peripheral surface of which joins the planar bottom surface of said heat-insulating member and is spaced inwardly of the lower edge of the planar bottom surface of said heat-insulating member, whereby an inwardly extending, downwardly facing planar ledge is formed at the interface of said heat-insulating member and said casting member and above the solidification commencing point; and (E) comprising a thin-walled hollow portion extending along the direction in which the solidified metal is pulled out;

(iii) a heat-insulating material filled in the inner space of said thin-walled hollow portion; and (iv) a molten metal supplying device including a molten metal level controller located in said molten metal receiving vessel, said molten metal level controller comprising a float and at least one dip tube arranged to maintain the level of the molten metal in said molten metal receiving vessel constant.

3. An apparatus for continuously producing an elongated hollow metallic ingot having a cross-section in the form of a circle or other closed loop form, said apparatus comprising:

(a) an annular water-cooled metallic mold having an open upper end and an open lower end with the cross-section of the inner periphery thereof being so arranged as to correspond to that of the outer periphery of the hollow metallic ingot;

(b) a core member located within the inner space of said mold with the cross-section of the outer periphery thereof being so shaped as to correspond to that of the inner periphery of the hollow metallic ingot, thereby forming together with said mold a casting passage therebetween which is adapted to pass therethrough molten metal supplied thereinto from said open upper end for continuously causing solidification of the molten metal between the open upper end and the open lower end of said casting passage so as to produce the hollow metallic ingot; and (c) a movable supporting base member adapted to be initially so located as to close said open lower end of said casting passage for supporting the molten metal supplied in said casting passage thereon and then to be gradually lowered away from said open lower end so as to pull out the solidified metal supported thereon as the solidification of the molten metal continuously proceeds, while the molten metal is continuously supplied into said casting passage so as to compensate for the amount of metal solidified and pulled out from said casting passage, thereby permitting the hollow metallic ingot to be continuously produced, the solidification point of the molten metal within said casting passage being maintained substantially within the range between said open upper and lower ends of said casting passage;

(d) said core member comprising:

(i) a heat-insulating member:

(A) made of a heat-insulating material;

(B) having a molten metal receiving vessel integrally formed therein;

(C) being formed with at least one molten metal conducting passage communicating said molten metal receiving vessel with said casting passage for supplying the molten metal from said vessel into said casting passage; and (D) having a planar bottom surface;

(ii) a casting member:

(A) in the form of a thin-walled cup having a planar top surface secured to the planar bottom surface of said heat-insulating member;

(B) made of graphite or carbonic material; and (C) the outer peripheral surface of which is tapered downwardly and inwardly and which extends by an appropriate range within which the solidification commencing point is located at an appropriate position so as to form a casting face of said core member; and (iii) a molten metal supplying device including a molten metal level controller located in said molten metal receiving vessel, said molten metal level controller comprising a float and at least dip tube arranged to maintain the level of the molten metal in said molten metal receiving vessel constant.

4. An apparatus for continuously producing an elongated hollow metallic ingot having a cross-section in the form of a circle or other closed loop form, said apparatus comprising:

(a) a first annular water-cooled metallic mold having an open upper end and an open lower end with the cross-section of the inner periphery thereof being so shaped as to correspond to that of the outer periphery of the hollow metallic ingot;

(b) a core member located within the inner space of said first annular mold with the cross-section of the outer periphery thereof being so shaped as to correspond to that of the inner periphery of the hollow metallic ingot, thereby forming together with said first annular mold a casting passage therebetween which is adapted to pass therethrough molten metal supplied thereinto from said open upper end for continuously causing solidification of the molten metal between the open upper end and the open lower end of said casting passage so as to produce the hollow metallic ingot;

(c) a movable supporting base member adapted to be initially so located as to close said open lower end of said casting passage for supporting the molten metal supplied in said casting passage thereon and then to be gradually lowered away from said open lower end so as to pull out the solidified metal supported thereon as the solidification of the molten metal continuously proceeds, while the molten metal is continuously supplied into said casting passage so as to compensate for the amount of metal solidified and pulled out from said casting passage, thereby permitting the hollow metallic ingot to be continuously produced, the solidification point of the molten metal within said casting passage being maintained substantially within the range between said open upper and lower ends of said casting passage;

(d) said core member comprising:

(i) a first heat-insulating member:

(A) made of a heat insulating material;

(B) having a molten metal receiving vessel integrally formed therein;

(C) being formed with at least one molten metal conducting passage communicating said molten metal receiving vessel with said casting passage for supplying the molten metal from said vessel into said casting passage; and (D) having a planar bottom surface;

(ii) a casting member:

(A) made of graphite or a carbonic material;

(B) having a planar top surface secured to the planar bottom surface of said first heat-insulating member;

(C) comprising a thin-walled hollow portion extending along the direction in which the solidified metal is pulled out;

(D) the outer peripheral surface of which is tapered downwardly and inwardly and which extends by an appropriate range within which the solidification commencing point is located at an appropriate position so as to form a casting face of said core member; and (E) the top edge of the outer peripheral surface of which joins the planar bottom surface of said heat-insulating member and is spaced inwardly of the lower edge of the planar bottom surface of said heat-insulating member, whereby an inwardly extending, downwardly facing planar ledge is formed at the interface of said first heat-insulating member and said casting member and above the solidification commencing point;

(iii) a molten metal supplying device including a molten metal level controller located in said molten metal receiving vessel, said molten metal level controller comprising a float and at least one dip tube arranged to maintain the level of the molten metal in said molten metal receiving vessel constant;

(e) a second annular water-cooled metallic mold secured to said first heat-insulating member; and (f) a second heat-insulating member interposed between said second annular water-cooled metallic mold and said casting member.

5. Apparatus according to claim 1, wherein the outer peripheral edge of said heat-insulating member is rounded off downwardly inwardly.

6. Apparatus according to claim 1, wherein another heat-insulating member made of a heat-insulating material is provided on at least the upper portion of the inner peripheral surface of said water-cooled mold, the inner peripheral edge of said another heat-insulating member projecting inwardly into said casting passage beyond the inner peripheral surface of said mold.

7. Apparatus according to claim 6, wherein another casting member made of graphite or a carbonic material is provided on the inner peripheral surface of said another heat-insulating member, the inner peripheral surface of said another casting member being tapered downwardly outwardly so as to form the casting face of said mold.

8. Apparatus according to claim 1, wherein a heat-insulating material is filled in the inner space of said thin-walled cup.

* * * * *

UNITED STATES PATENT AND TRADEMARK OFFICE

CERTIFICATE OF CORRECTION

PATENT NO. : 4,719,959

DATED : Jan. 19, 1988

INVENTOR(S) : Susumu Nawata, et al.

It is certified that error appears in the above-identified patent and that said Letters Patent is hereby corrected as shown below:

-- The Foreign Application Priority Data is recorded incorrectly. It should read:

Dec. 6, 1984 [JP] Japan .....59-258310

Signed and Sealed this

Second Day of August, 1988

*Attest:*

DONALD J. QUIGG

*Attesting Officer*

*Commissioner of Patents and Trademarks*